US009505603B2

(12) United States Patent
Hennen

(10) Patent No.: US 9,505,603 B2
(45) Date of Patent: Nov. 29, 2016

(54) SINGLE USE DISPENSE HEAD WITH KEY CODE

(71) Applicant: ENTEGRIS, INC., Billerica, MA (US)

(72) Inventor: John M. Hennen, Carver, MN (US)

(73) Assignee: ENTEGRIS, INC., Billerica, MA (US)

( * ) Notice: Subject to any disclaimer, the term of this patent is extended or adjusted under 35 U.S.C. 154(b) by 0 days.

(21) Appl. No.: 14/648,084

(22) PCT Filed: Nov. 27, 2013

(86) PCT No.: PCT/US2013/072399

§ 371 (c)(1),
(2) Date: May 28, 2015

(87) PCT Pub. No.: WO2014/085701

PCT Pub. Date: Jun. 5, 2014

(65) Prior Publication Data

US 2015/0298960 A1 Oct. 22, 2015

Related U.S. Application Data

(60) Provisional application No. 61/731,233, filed on Nov. 29, 2012.

(51) Int. Cl.

| | |
|---|---|
| ***B67D 7/02*** | (2010.01) |
| ***B67D 7/34*** | (2010.01) |
| *B65D 47/32* | (2006.01) |
| *B65D 47/06* | (2006.01) |

(52) U.S. Cl.

CPC ..... *B67D 7/344* (2013.01); *B67D 7/0288* (2013.01); *B65D 47/06* (2013.01); *B65D 47/32* (2013.01); *B67D 7/0283* (2013.01)

(58) Field of Classification Search

CPC .. B67D 7/344; B67D 7/0288; B67D 7/0283; B65D 47/06; B65D 47/32

See application file for complete search history.

(56) References Cited

U.S. PATENT DOCUMENTS

| | | | | |
|---|---|---|---|---|
| 4,291,821 | A * | 9/1981 | Nezworski | B67D 1/0832 137/212 |
| 5,203,477 | A * | 4/1993 | Lo | B67D 1/0832 137/212 |
| 5,875,921 | A * | 3/1999 | Osgar | B67D 7/02 222/1 |
| 6,015,068 | A * | 1/2000 | Osgar | B01J 4/00 222/105 |
| 6,021,802 | A * | 2/2000 | Leifels | B67D 7/344 137/320 |
| 6,070,624 | A * | 6/2000 | Bilbrey | B67D 1/0829 137/625.19 |
| 6,095,382 | A | 8/2000 | Gross | |
| 6,543,654 | B1 * | 4/2003 | Uhl | B65D 47/06 215/253 |
| 8,464,499 | B2 * | 6/2013 | Asp | B65C 7/00 235/375 |
| 2006/0225812 | A1 * | 10/2006 | Hennen | B65D 51/1683 141/367 |
| 2008/0073383 | A1 | 3/2008 | McDonald | |
| 2010/0176152 | A1 | 7/2010 | Johnson | |
| 2011/0204090 | A1 | 8/2011 | Worthington et al. | |
| 2011/0309114 | A1 * | 12/2011 | Chen | B67D 7/344 222/464.1 |

FOREIGN PATENT DOCUMENTS

WO WO 2012/122635 A1 9/2012

* cited by examiner

*Primary Examiner* — Frederick C Nicolas

(74) *Attorney, Agent, or Firm* — Wilmer Cutler Pickering Hale and Dorr LLP

(57) ABSTRACT

A two-part key coded device that can be added to existing container and dispense stations. The key coded device includes a female key ring that is retrofitted to an existing bung and a compatible male key ring that is retrofitted to an existing or new dispense head. The key code system can enable only a specific or compatible type of chemical to be connected to the dispense head, and provides a measure of safety against inadvertently connecting the wrong type of chemical.

21 Claims, 11 Drawing Sheets

SINGLE USE DISPENSE HEAD WITH KEY CODE

RELATED APPLICATIONS

This present application is a National Phase entry of PCT Application No. PCT/US2013/072399, filed Nov. 27, 2013, which claims priority to U.S. Provisional Patent Application No. 61/731,233, filed Nov. 29, 2012, the disclosures of which are incorporated by reference herein in their entirety.

FIELD OF THE DISCLOSURE

The present disclosure is generally directed to the field of pressurized dispensing systems for liquids. More specifically, the present disclosure is directed to a method and apparatus for keyed mating of containers and dispense heads for pressurized dispensing systems.

BACKGROUND OF THE DISCLOSURE

Key coded dispense heads are recognized in the art. See, for example, U.S. Patent Application Publication No. 2009/0057347 to Leys et al. and U.S. Pat. No. 8,464,499 to Asp et al., owned by the owner of the instant application and the disclosure of which are incorporated by reference herein in their entirety, except for any patent claims and any express definitions contained therein. The key coded dispense heads can provide some assurance that a container (and chemical contained therein) is compatible with the process and apparatus to which it is connected by providing a physical barrier to connecting with the wrong container.

Nevertheless, there are existing dispensing systems are not key coded, and as such are susceptible to being errantly connected to the wrong process chemical. Such dispensing systems pose a risk to damaging equipment that is not compatible with an errantly connected process chemical, and, in some instances, pose an injury risk to operating personnel.

A device that can be implemented with existing dispensing systems to provide a physical barrier to errant connection without interfering with normal operation and without requiring the replacement of major components of the existing system would be welcomed in the art.

SUMMARY

Various embodiments disclosed herein include a two-part key code device that can be field installed or otherwise added to existing container and dispense stations. The key code ring can be coupled to the outside neck of the container connection in a non-wetted area. The existing dispense head can then be modified to include the new code ring that mates with the container ring.

The two-part retrofit system enables current connection systems to incorporate a barrier key code connection capable of thousands of unique, specific key code combinations to promote safety. In some embodiments, the components are all plastic and non-wetted, and include snap-on assembly. The container ring that rotate with the dispense head while engaging the head, and does not interfere with existing closures.

Structurally, various disclosed embodiments are of a field installation kit for keying a container and a dispensing system, the kit comprising a first key ring that includes a plurality of protrusions, the plurality of protrusions defining a protrusion pattern. A second key ring can define a plurality of pockets, the plurality of pockets defining a pocket pattern that is complementary to the protrusion pattern of the first key ring, the protrusion pattern being configured to mesh within the pocket pattern. One of the first key ring and the second key ring is adapted for coupling with a dispense head, whereas the other of the first key ring and the second key ring is adapted for coupling with a bung of the container. The other of the first key ring and the second key ring can be configured to freely rotate about an exterior of a neck portion of the bung.

In one embodiment, the first key ring is an inner key ring and the second key ring is an outer key ring, the inner key ring being surrounded by the outer key ring when the protrusion pattern is engaged within the pocket pattern. The outer key ring can include a flange portion that extends radially inward from a perimeter portion to define an inner radius. Also, the bung can include external threads that define an outer radius, the outer radius being greater than the inner radius of the flange portion. The flange portion can include structure that defines a plurality of slots that extend radially outward from the inner radius.

In one embodiment, a guard for covering an opening of the bung can be provided to prevent particulates from entering the container. An assembly tool adapted surround the guard and to contact the outer key ring can also be included in the kit.

In one embodiment, a first key ring portion and a second key ring portion are joined together to form one of the first key ring and the second key ring. The first key ring portion and the second key ring portion can include at least one clasping structure to join the first key ring portion to the second key ring portion. The first key ring portion and the second key ring portion can be separate components, or can be hinged together to form a clamshell arrangement.

In various embodiments, the field installation kit includes instructions that are provided on a tangible medium that describe assembly of the key code device. The tangible medium can comprise, for example, printed matter or a non-transitory computer-readable medium for access with a digital device. The instructions can include:

- coupling one of the first key ring and the second key ring to a dispense head;
- coupling the other of the first key ring and the second key ring to a bung of the container, such that the other of the first key ring and the second key ring freely rotates about an exterior of a neck portion of the bung;
- coupling the dispense head having the one of the first key ring and the second key ring coupled thereto with the bung having the other of the first key ring and the second key ring coupled thereto, so that the protrusion pattern is engaged within the pocket pattern; and
- coupling the dispense head to the bung.

In some embodiments, the instructions can further comprise inserting the guard into the bung before the step of coupling the other of the first key ring and the second key ring to a bung of the container, then removing the guard from the bung after the step of inserting and before the step of coupling the dispense head with the bung. In other embodiments, the instructions can further comprise inserting the guard into the bung before the step of coupling the other of the first key ring and the second key ring to a bung of the container, engaging the assembly tool with the outer key ring while the outer key ring is coupled to the bung of the container and while the guard is inserted within the bung, exerting a force on the assembly tool while the assembly tool is engaged with the outer key ring, causing the flange portion of the outer key ring to course over the external threads of the bung, and, after the step of exerting, removing the assembly tool from engagement with the outer key ring and the guard from the bung.

In one embodiment, the instructions can further comprise positioning the first key ring portion and the second key ring portion proximate the neck portion of the bung, and joining the first key ring portion to the second key ring portion so that the first key ring portion and the second key ring portion form one of the first key ring and the second key ring that surrounds the neck portion of the bung.

In various embodiments of the disclosure, a method for field installing a keying system to a container and a dispensing system is disclosed, comprising:

providing a first key ring that includes a plurality of protrusions, the plurality of protrusions defining a protrusion pattern;

providing a second key ring that defines a plurality of pockets, the plurality of pockets defining a pocket pattern that is complementary to the protrusion pattern of the first key ring;

coupling one of the first key ring and the second key ring to a dispense head;

coupling the other of the first key ring and the second key ring to a bung of the container, such that the other of the first key ring and the second key ring freely rotates about an exterior of a neck portion of the bung;

coupling the dispense head having the one of the first key ring and the second key ring coupled thereto with the bung having the other of the first key ring and the second key ring coupled thereto, so that the protrusion pattern is engaged within the pocket pattern; and coupling the dispense head to the bung.

The method for field installing a keying system to a container and a dispensing system can also include:

providing a guard for insertion into the bung, the guard covering an opening of the bung to prevent particulates from entering the container;

inserting the guard into the bung before the step of coupling the other of the first key ring and the second key ring to a bung of the container; and removing the guard from the bung after the step of inserting and before the step of coupling the dispense head with the bung Additionally, the method for field installing a keying system to a container and a dispensing system can also include:

providing a guard for insertion into the bung, the guard covering an opening of the bung to prevent particulates from entering the container; and providing an assembly tool adapted to contact the outer key ring while the outer key ring is coupled to the bung of the container and while the guard is inserted within the bung;

inserting the guard into the bung before the step of coupling the other of the first key ring and the second key ring to a bung of the container;

engaging the assembly tool with the outer key ring while the outer key ring is coupled to the bung of the container and while the guard is inserted within the bung;

exerting a force on the assembly tool while the assembly tool is engaged with the outer key ring, causing the flange portion of the outer key ring to course over the external threads of the bung; and after the step of exerting, removing the assembly tool from engagement with the outer key ring and the guard from the bung.

In one embodiment, the method for field installing a keying system to a container and a dispensing system further comprises:

providing a first key ring portion and a second key ring portion to joined together to form one of the first key ring and the second key ring;

positioning the first key ring portion and the second key ring portion proximate the neck portion of the bung; and joining the first key ring portion to the second key ring portion so that the first key ring portion and the second key ring portion form one of the first key ring and the second key ring that surrounds the neck portion of the bung.

DETAILED DESCRIPTION

Figure 1:
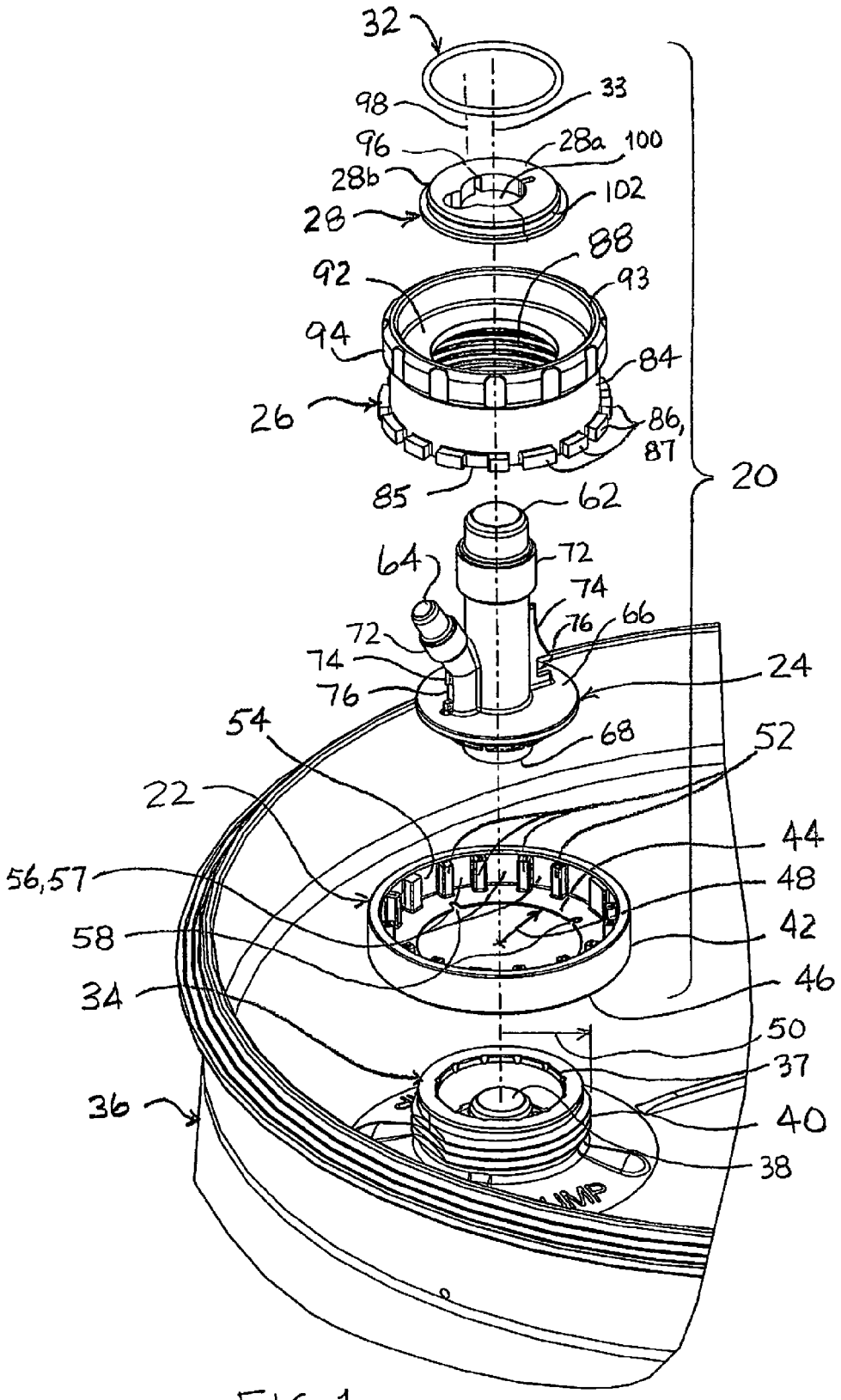
FIG. 1 is an exploded view of a key code assembly, bung and drum in an embodiment of the disclosure.

Referring to FIGS. 1 through 6, a key code assembly 20 is depicted in an embodiment of the disclosure in various stages of assembly. The key code assembly 20 includes an outer or female key ring 22, a dispense head 24, an inner or male key ring 26, a retainer 28 and an exterior O-ring 32. The key code assembly 20 is adapted for coupling with a bung 34 that is coupled to a drum 36. The bung 34 defines an opening 37, and typically includes a dispensing line 38 centered therein and external threads 40 that mate with the key code assembly 20.

The key code assembly 20 defines a central axis 39 about which the various components, when assembled, are concentric. For purposes of this disclosure, "axial" is a coordinate that is parallel to the central axis 39. Also for this disclosure, "proximal" refers to a direction that is external to the drum 36 and away from the dispensing line 38 of the bung 34 (i.e., upwards in the depictions of FIGS. 1 through 6), and "distal" refers to a direction that is external to the drum 36 and towards the dispensing line 38 (i.e., downward in the depictions of FIGS. 1 through 6).

The dispense head 24, retainer 28, exterior O-ring 32 and bung 34 are existing components from a prior assembly. The outer key ring 22 and the inner key ring 26 are provided as part of a retrofit kit. In one embodiment, the outer key ring 22 includes a perimeter portion 42 and a flange portion 44 that extends radially inward from a lower edge 46 of the perimeter portion 42 to define an inner radius 48. In one embodiment, the inner radius 48 of the flange portion 44 is less than an outer radius 50 of the external threads 40 of the bung 34. A plurality of protrusions 52 extend radially inward from an inside surface 54 of the perimeter portion 42 to define a plurality of pockets 56 therebetween. The plurality of pockets 56 can define a pocket pattern 57. The flange portion 44 can also have a plurality of slots 58 formed thereon that extend radially outward from the inner radius 48.

In the depicted embodiment, the dispense head 24 includes a dispensing port 62 and a venting port 64 integrally formed with or otherwise coupled to a flange 66. The dispensing port 62 can include a collar portion 68 of expanded diameter (best depicted in FIG. 4) to define a female port for mating with a male end of the dispensing line 38 of the bung 34. The dispensing and venting ports 62 and 64 can each include threaded portions 72 to facilitate connection with external lines. The venting port 64 can also include gussets 74 each having a notch 76 formed thereon. The dispense head 24 can further include an O-ring or gasket member 78 (FIG. 4) for sealingly engaging with an inner surface 82 of the bung 34.

The inner key ring 26 can comprise a coupler 84 having a distal end 85 with protrusions 86 that extend radially outward therefrom. The protrusions 86 can define a protrusion pattern 87 normal to the central axis 39. The coupler 84 can be cylindrical and can include an internal threaded portion 88 that mates with the external threads 40 of the bung 34. The inner key ring 26 can also include an internal flange 92 that extends radially inwards from the coupler 84. In one embodiment, the inner key ring 26 also includes a proximal end 93 having a grip portion 94 to accommodate gripping of the coupler 84 by hand or with tools.

The retainer 28 can include two sections 28*a* and 28*b* joined together at a living hinge 96 for hinged rotation about a hinge axis 98, the hinge axis 98 being substantially parallel to the central axis 39 when assembled. In one embodiment, the sections 28*a* and 28*b* cooperate to define an aperture 100 shaped to accommodate the exterior shapes of the dispensing and venting ports 62 and 64. The retainer 28 can be fabricated from a solid material, such as PTFE. The external O-ring 32 fits within a gland 102 defined on the perimeter of the retainer 28. The O-ring 32 can be made of a suitable flexible material, such as FEP encapsulated white silicone.

Figure 2:
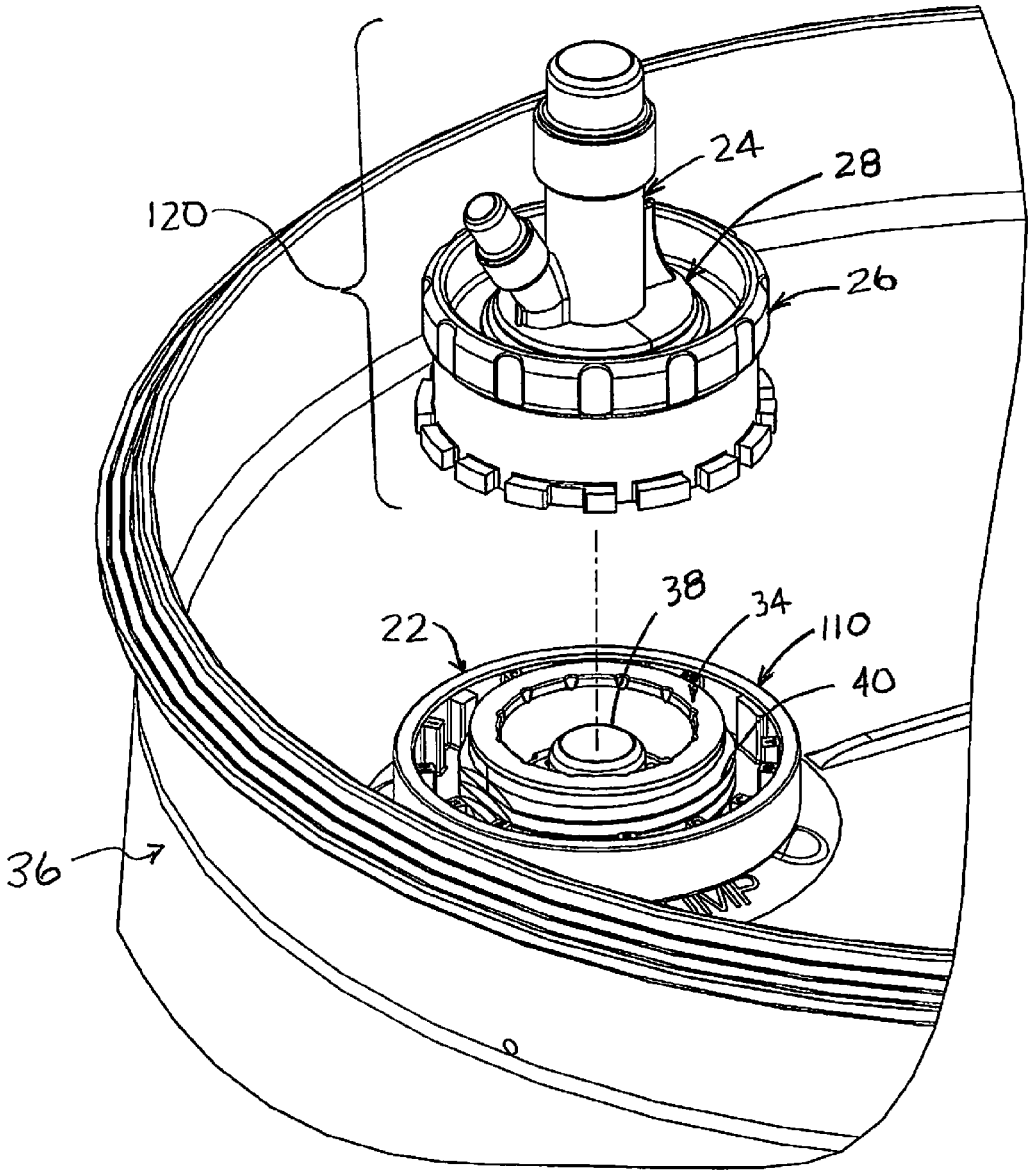
FIG. 2 is depicts a bung subassembly and a dispense head subassembly of the key code assembly of FIG. 1.
Figure 3:
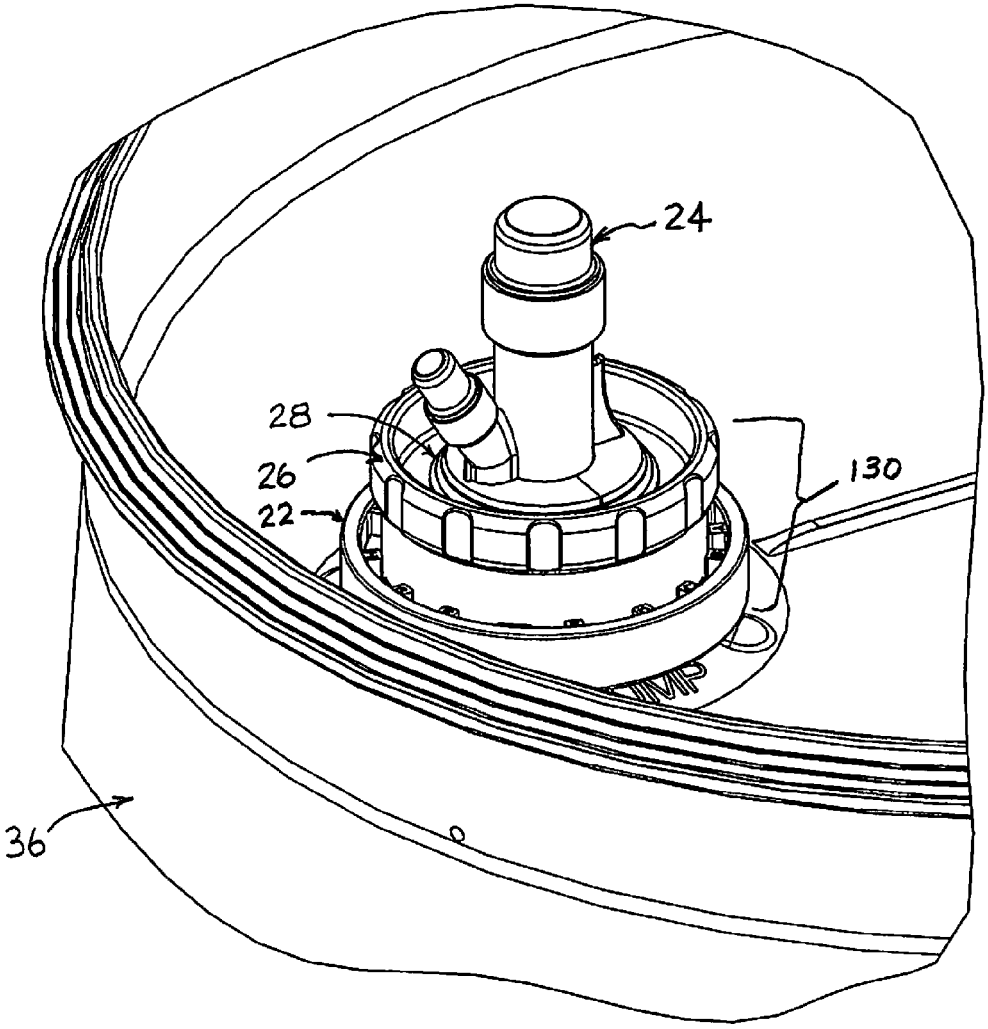
FIG. 3 depicts the fully assembled key code assembly to the bung and drum of FIG. 1.

The key code assembly 20 comprises two subassemblies: the bung subassembly 110 and the dispense head subassembly 120 (FIG. 2). The bung subassembly 110 is assembled by sliding the outer key ring 22 in the distal direction over the external threads 40 of the bung 34. For embodiments where the inner radius 48 of the outer key ring 22 is less than the outer radius 50 of the external threads 40 of the bung 34, there is an interference between the flange portion 44 and the external threads 40 such that the flange portion 44 courses over the external threads 40 as the outer key ring 22 is slid over the bung 34. In other embodiments, the inner radius 48 of the outer key ring 22 is greater than the outer radius 50 of the external threads 40, so that the outer key ring 22 can be slid over the bung 34 without coursing over the external threads 40. The inner radius 48 is also dimensioned to be greater than a radius 114 of a neck portion 112 (FIG. 4) of the bung 34.

The dispense head subassembly 120 comprises the dispense head 24, the inner or male key ring 26, the retainer 28 and the exterior O-ring 32. In assembly, the dispense head 24 is inserted within the inner key ring 26 so that an upper surface of the flange 66 of the dispense head 24 contacts a lower surface of the internal flange 92 of the inner key ring 26. The sections 28*a* and 28*b* of the retainer 28 are then opened about the living hinge 96 and clamped about the dispensing and venting ports 62 and 64 and within the notches 76 of the gussets 74. The external O-ring 32 is then snapped into the gland 102 of the retainer 28 to hold the retainer 28 in a closed position. Upon completion of the dispense head subassembly 120, the bottom surface of the retainer 28 is in contact with the upper surface of the internal flange 92 of the inner key ring 26, and the retainer 28 captures the dispense head 24 within the inner key ring 26.

The key code assembly 20 is designed so that, for a chemical that is compatible for use with a given system, the protrusion pattern 87 of the protrusions 86 of the inner key ring 26 are configured to be complementary with the pocket pattern 57 of the outer key ring 22. That is, the protrusions 86 are configured to slidably engage in the axial direction to seat within the pockets 56 of the outer key ring 22. The dimensions of the protrusions 86 and corresponding pockets 56 can be asymmetrical (i.e., of non-uniform tangential dimensions) so that the dispense head subassembly 120 can mate only with one bung subassembly 110 or only with certain subsets of bung subassemblies compatible with bung assembly 110.

Figure 4:
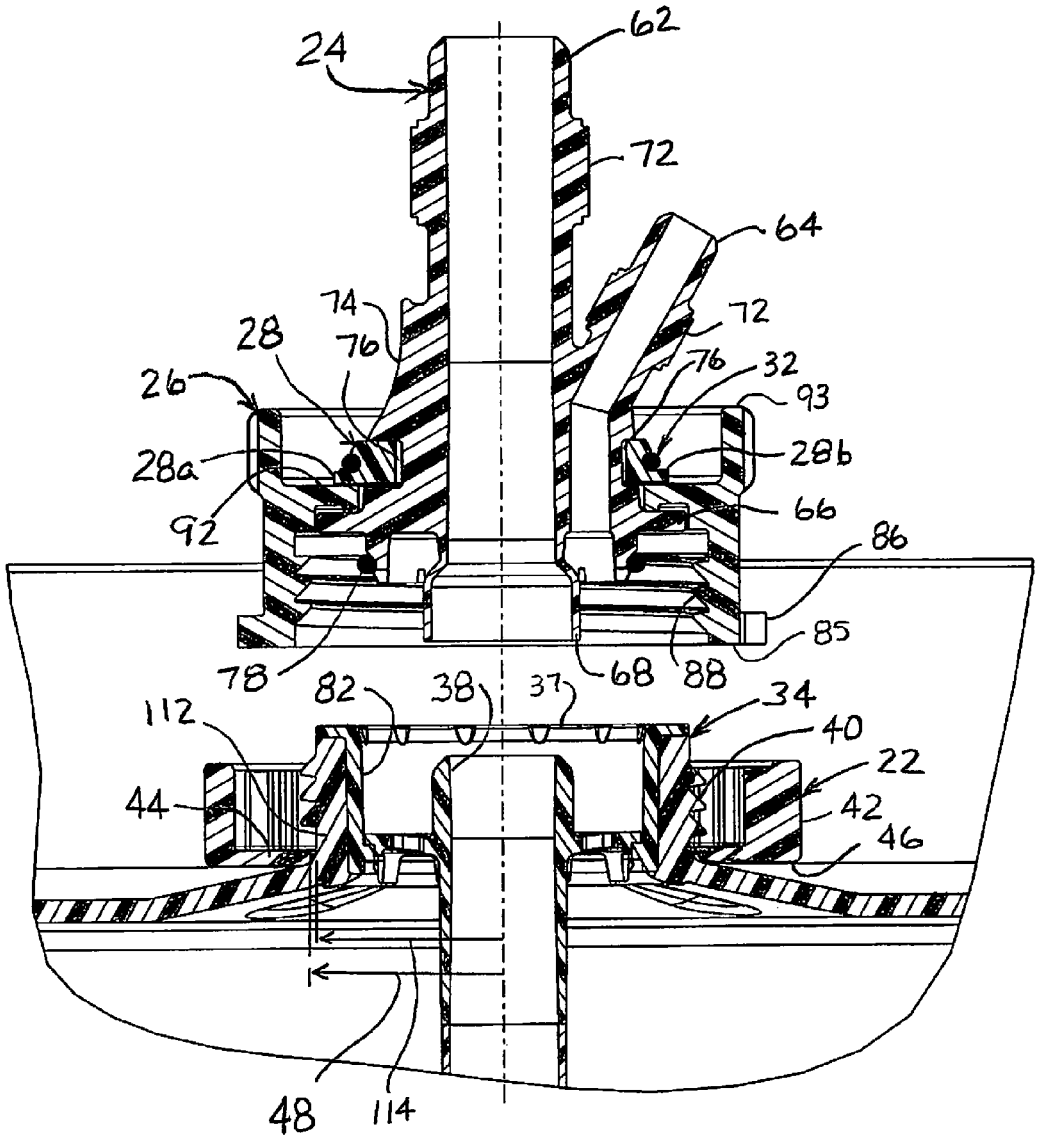
FIG. 4 is a sectional view of a bung subassembly and a dispense head subassembly of the key code assembly of FIG. 2.
Figure 5:
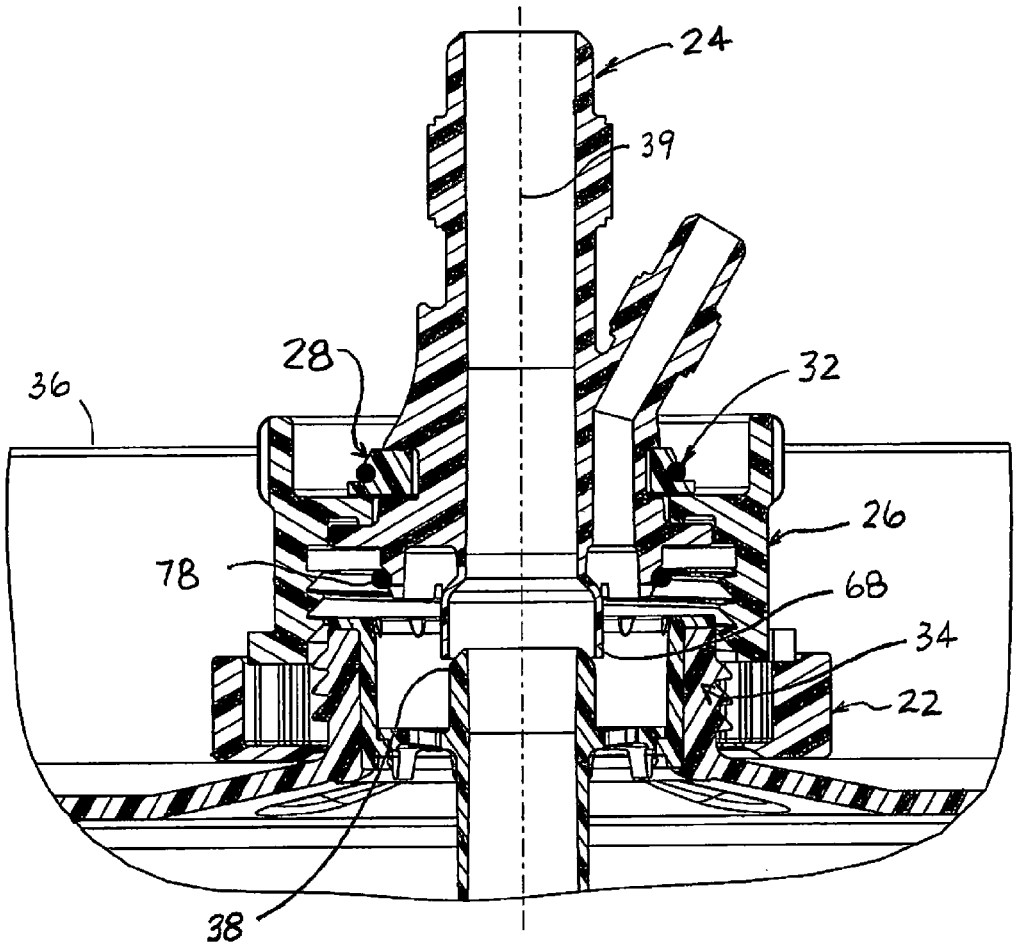
FIG. 5 is a sectional view of the bung and dispense head subassemblies of FIG. 4 being brought into contact with each other.
Figure 6:
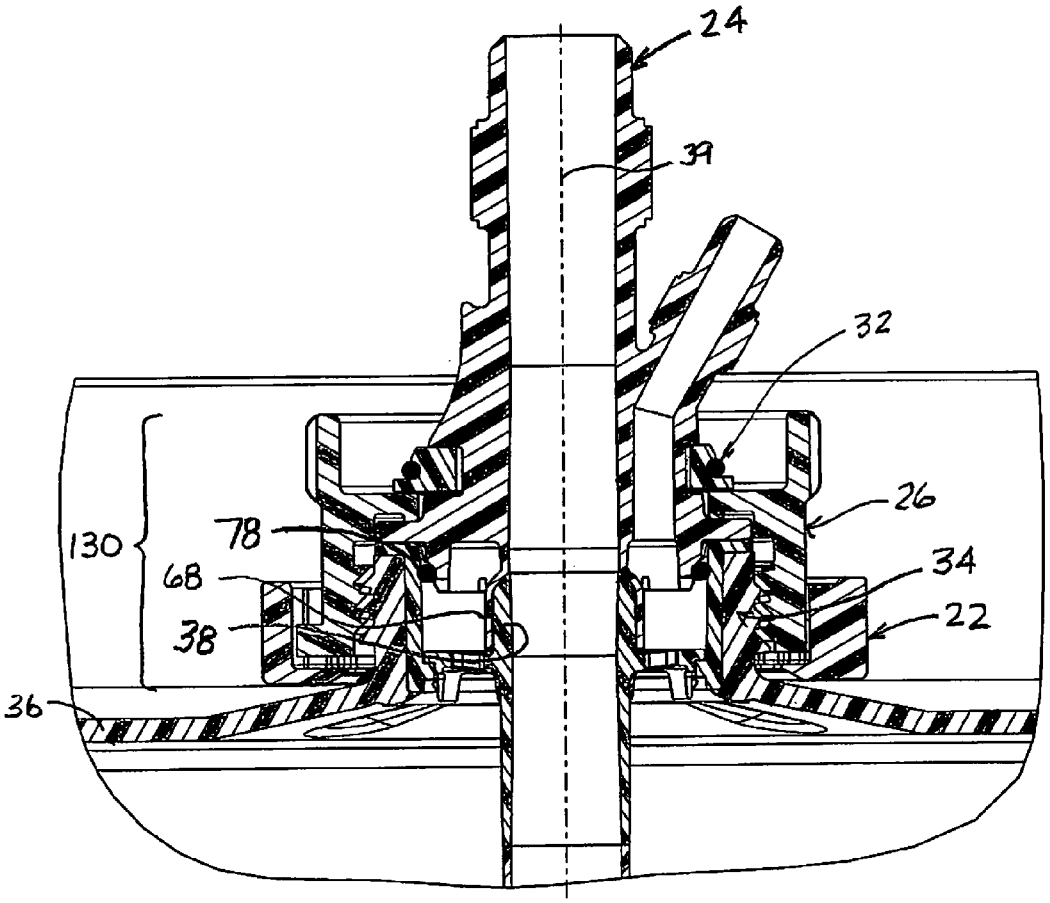
FIG. 6 is a sectional view of the fully assembled key code assembly of FIG. 3.
Figure 7:
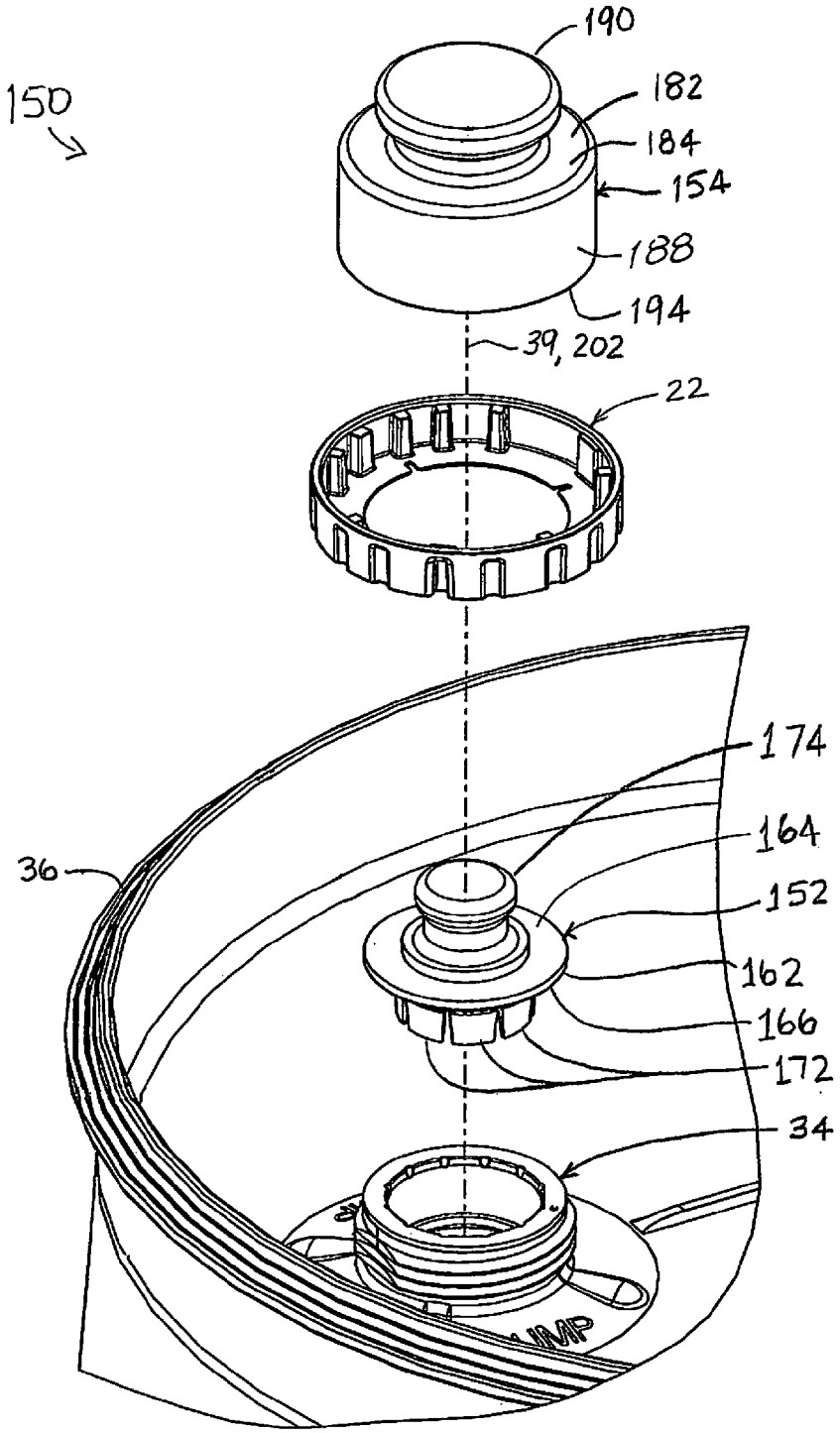
FIG. 7 is an exploded perspective view of components used in the buildup of a bung assembly in an embodiment of the disclosure.
Figure 8:
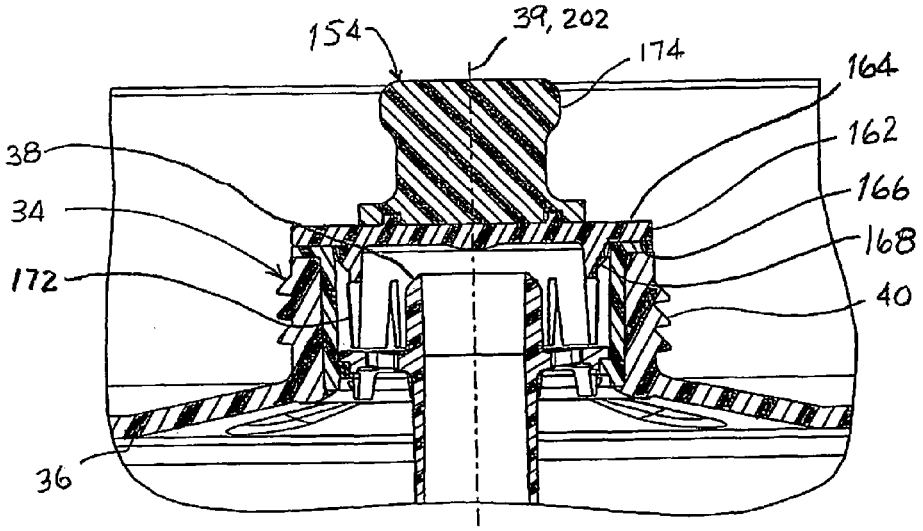
FIGS. 8 through 12 are sectional views of the components of FIG. 7 at various stages of the buildup of the bung assembly in a disclosed embodiment.
Figure 9:
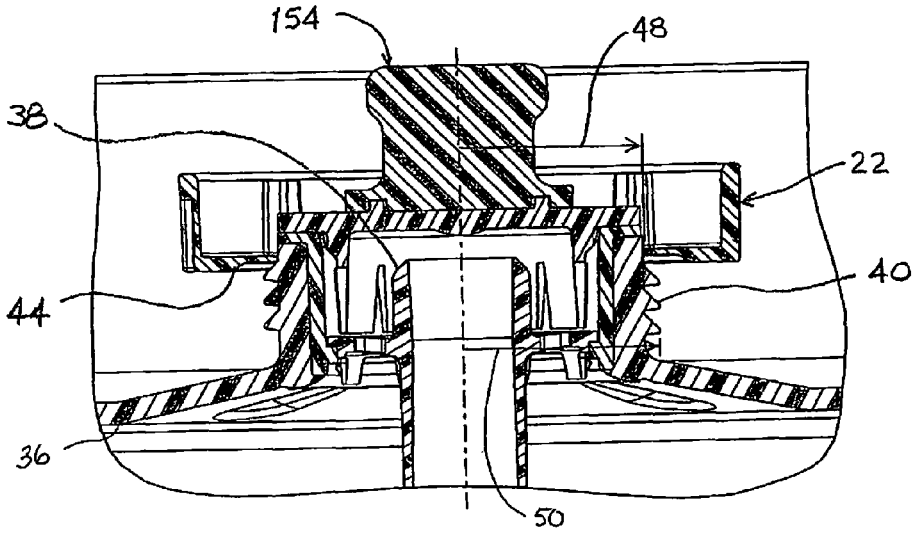
Figure 10:
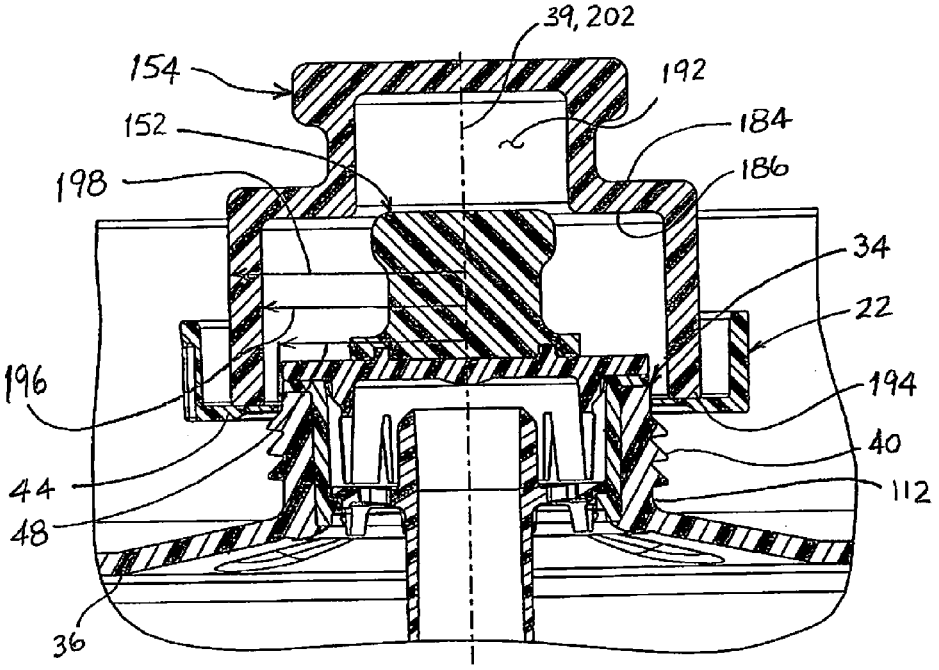
Figure 11:
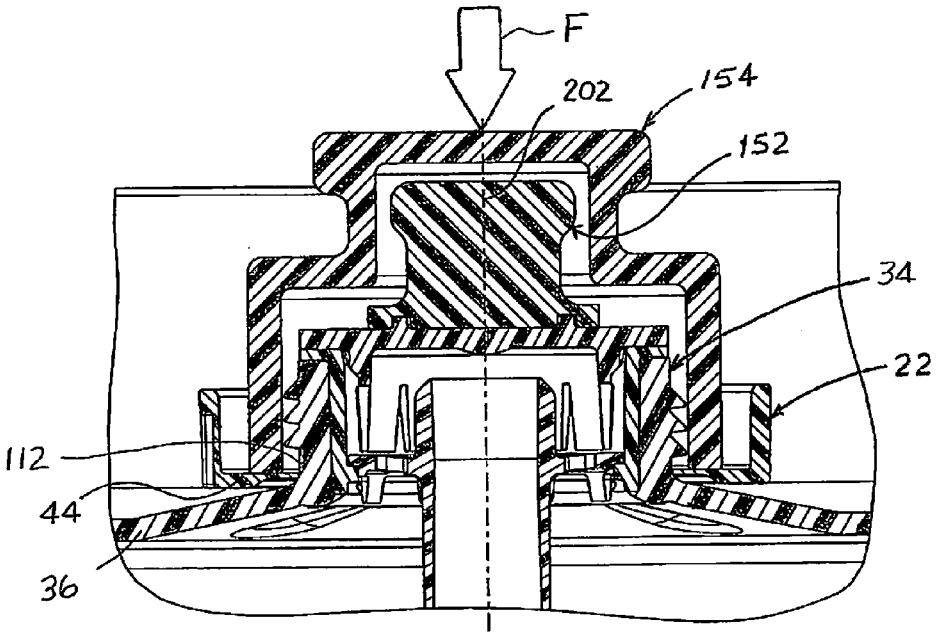

In operation, the dispense head assembly 120 is aligned over the bung assembly 110 (e.g., as depicted in FIG. 4) and brought into initial contact with the bung assembly 110 so that the collar portion 68 of the dispensing port 62 is substantially aligned with the dispensing line 38 of the drum 36 (e.g., FIG. 5). For certain embodiments, the dispense head assembly 120 can be arranged in any rotational orientation about the central axis 39. The outer key ring 22 is then rotated about the central axis 39 until a rotational orientation is found that enables the protrusion pattern 87 of the inner key ring 26 to mate with the pocket pattern 57 of the outer key ring 22. The outer key ring 22 is then slid axially (i.e., parallel to the central axis 39) into the inner key ring 26, such that the inner and outer key rings 26 and 22 define a keyed assembly 130. The keyed assembly 130 is then threaded onto the exterior threads 40 of the bung 34 via the internal threaded portion 88 of the coupler 84 until the dispense head assembly 120 is sealingly mounted to the bung 34.

Functionally, the patterns of the protrusions 86 and 52 of the inner key ring 26 and the outer key ring 22, respectively, enable coupling of the dispense head assembly 120 with the bung subassembly 110 only if the patterns are complementary. For dispense head subassemblies that are not compatible with the bung subassembly 110, the respective protrusions 86 and 52 can be patterned to physically interfere with each other in the axial direction (i.e., a direction parallel to the central axis 39) regardless of their rotational orientations with respect to each other. The interference can physically prevent the interior threads 88 of inner key ring 26 (and therefore the dispense head 24) from engaging with the external threads 40 of the bung 34, or otherwise prevents operational coupling between the inner key ring 26 and the bung 34. That is, when the inner key ring 26 and the outer key ring 22 are not complementary, the engagement between the dispense head assembly 120 and the bung subassembly 110 does not progress beyond that which is depicted in FIG. 5. In this way, the key code system enables only a specific chemical or compatible subset of chemicals to be connected to the dispense head 24, thus providing a measure of safety against inadvertently connecting the wrong type of chemical.

The slots 58 enable the innermost portion of the flange portion 44 to flex as the outer key ring 22 courses in the axial direction (i.e., a direction parallel to the central axis 39) over the external threads 40 during installation on the bung 34. The external O-ring 32 operates to hold the two sections 28*a* and 28*b* of the retainer 28 in a closed orientation. The smaller radius of the neck portion 112 relative to the inner radius 48 of the outer key ring 22 enables the outer key ring 22 to rotate freely about the neck portion 112. For embodiments where the inner radius 48 of the outer key ring 22 is less than the outer radius 50 of the external threads 40 of the bung 34, the outer key ring 22 is effectively captured between the drum 36 and lowermost portion of the external threads 40 of the bung 34.

Also, in the depicted embodiment, the outer key ring 22 of the bung subassembly 110 is free to rotate about the neck portion 112 of the bung 34, and does not interfere with existing closure connections.

Referring to FIGS. 7 through 13, accessories 150 for building up the bung subassembly 110 is depicted in a disclosed embodiment, along with a method for implementing the accessories 150 in an embodiment of the disclosure. The accessories 150 include a guard 152 and an assembly tool 154. The guard 152 comprises a flange portion 162 having a proximal face 164 and a distal face 166. In one embodiment, a shoulder portion 168 extends from the distal face 166. A plurality of tabs 172 can project axially from the distal shoulder portion 168. A handle portion 174 can also extend from the proximal face 164.

The assembly tool 154 comprises a flange portion 182 having a proximal face 184 and a distal face 186. In one embodiment, a skirt portion 188 extends from the distal face 186. A handle portion 190 can also extend from the proximal face 184. The handle portion 190 can define a hollow cavity 192. The hollow cavity 192 can be dimensioned so that the handle portion 174 can freely fit within the hollow cavity 192 (i.e., without contact between the handle portion 174 and the boundaries of the hollow cavity 192). The skirt portion 188 can include a distal end 194 that defines an inner radius 196 that is greater than the inner radius 48 of the flange portion 44 of the outer key ring 22, and an outer radius 198 that fits within the perimeter portion 42 of the outer key ring 22.

Functionally, a purpose of the guard 152 is to prevent particulates from entering the drum 36. Particularly for configurations where the flange portion 44 of the outer key ring 22 courses over the external threads 40, there can be significant particle generation proximate the opening 37 of the bung 34. The guard 152 serves as a barrier to the particulates that are generated during buildup of the bung subassembly 110.

The tabs 172 of the guard 152 can serve to visually and/or physically guide the guard 152 into the opening of the bung 34. The shoulder portion 168 can have a diameter that is slightly less than the diameter of the opening 37 of the bung 34, which acts to substantially center the guard 152 within the opening 37. The inner and outer radii 196, 198 of the skirt portion 188 are dimensioned so that the distal end 194 of the skirt portion 188 does not contact the exterior threads 40 of the bung 34 while contacting the flange portion 44 of the outer ring 22. The inner radius 196 of the skirt portion 188 can be set radially outward from the exterior threads 40 at a distance that enables the flange portion 44 to flex as the flange portion 44 courses over the exterior threads 40.

Figure 12:
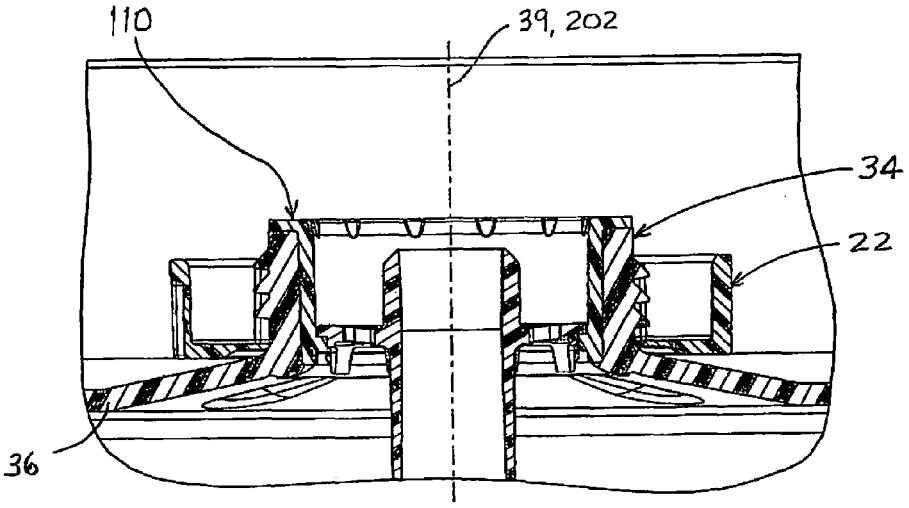

A method for building up the bung subassembly 110 is as follows:

- Insert the guard 152 into the opening 37 of the bung 34, so that the flange portion 182 of the guard 152 covers the opening 37 (FIG. 8).
- Place the outer key ring 22 so that the flange portion 44 rests on the proximal end of the threads 40 of the bung 34 (FIG. 9).
- Place the assembly tool 154 so that the distal end 194 rests on the flange portion 44 of the outer key ring 22, and so that the assembly tool 154 is substantially centered about a central axis 202 of the outer key ring 22 (FIG. 10).
- Exert an axial force F that is parallel the central axis 202 so that the flange portion 44 of the outer key ring 22 courses over the exterior threads 40 of the bung 34, until the flange portion 44 is below the distal end of the threads 40 and surrounds the neck portion 112 of the bung 34 (FIG. 11).
- Remove the assembly tool 154 and the guard 152 to expose a fully assembled bung assembly 110 (FIG. 12).

Figure 13:
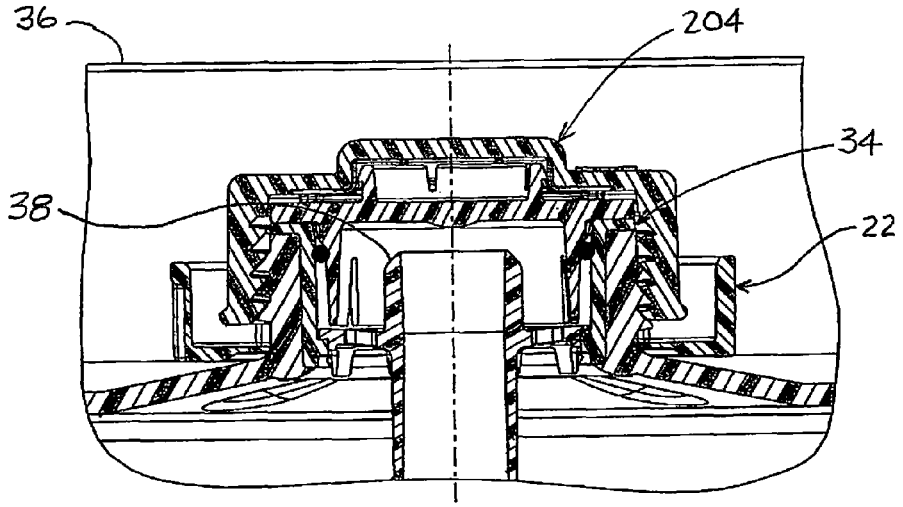
FIG. 13 is a sectional view of the bung assembly of FIG. 12 with a protective cap in a disclosed embodiment.

In one embodiment, a cap 204 can be threaded onto the external threads 40 of the bung 34 to hermetically seal the drum 36 in the absence of a dispense head 24 (FIG. 13).

Figure 14A:
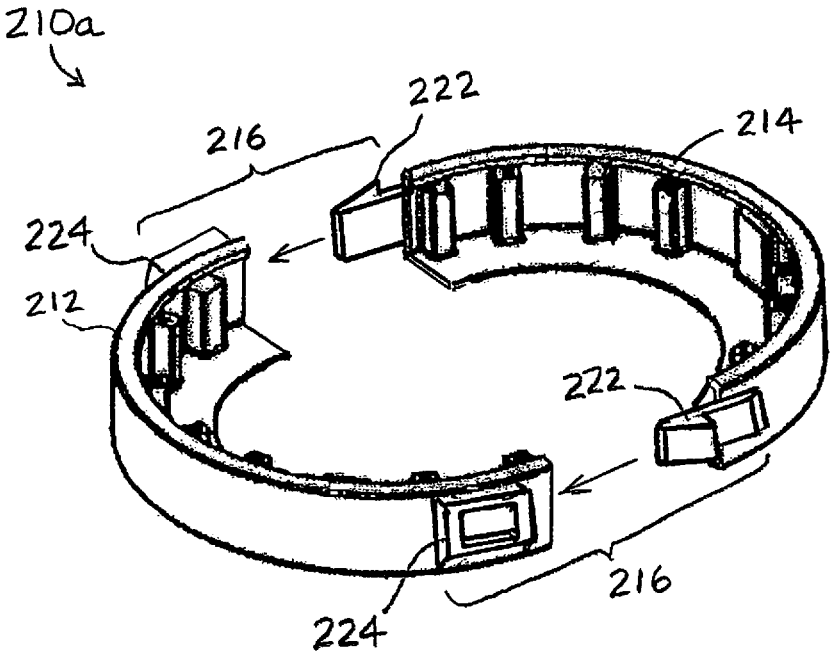
FIG. 14A is a perspective view of a split outer key ring in an embodiment of the disclosure.
Figure 14B:
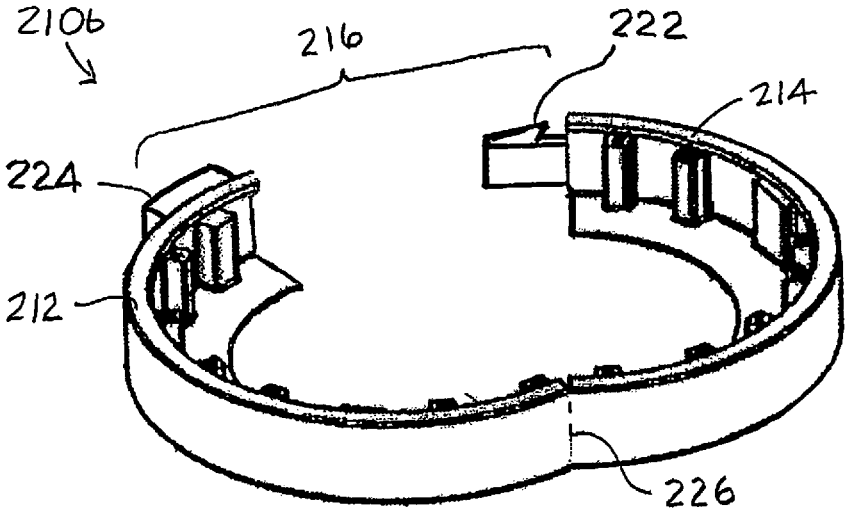
FIG. 14B is a perspective view of a clamshell outer key ring in an embodiment of the disclosure.

Referring to FIGS. 14A and 14B, a split outer key ring 210*a* and a clamshell outer key ring 210*b* are depicted in embodiments of the disclosure. The outer key rings 210*a* and 210*b* each include a first key ring portion 212 and a second key ring portion 214. The first and second key ring portions 212 and 214 include at least one clasping structure 216, such as a snap 222 and buckle 224 arrangement (depicted). The split outer key ring 210*a* includes two clasping structures 216. The clamshell outer key ring 210*b* includes only one clasping structure, with a living hinge 226 diametrically opposed to the clasping structure 216.

The clasping structure(s) 216 enable the first and second key ring portions 212 and 214 to be readily fastened together to define an outer key ring having the same key coding utility as described for the outer key ring 22. The first and second key ring portions 212 and 214 can be mounted laterally (i.e., from the side) to the neck portion 112 and joined together, without need for coursing the outer key ring(s) 210*a*, 210*b* over the threads 40 of the bung 34.

References to relative terms such as upper and lower, top and bottom, front and back, left and right, horizontal, or the like, are intended for convenience of description and are not contemplated as limiting, or its components, to any one positional or special orientation, unless otherwise explicitly stated. All dimensions depicted in the figures can vary with a potential design and the intended use of a specific embodiment without departing from the scope thereof.

Each of the additional figures and methods disclosed herein can be used separately, or in conjunction with other features and methods, to provide improved devices and methods for making and using the same. Therefore, combinations of features and methods disclosed herein may not be necessary to practice the invention as claimed in its broadest sense and are instead disclosed merely to particularly describe representative embodiments.

Various modifications to the embodiments may be apparent to one of skill in the art upon reading this disclosure. For example, persons of ordinary skill in the relevant art will recognize that the various features described for the different embodiments can be suitably combined, un-combined, and re-combined with other features, alone, or in different combinations, within the spirit of the disclosure. Likewise, the various features described above should all be regarded as example embodiments, rather than limitations to the scope or spirit of the disclosure.

Persons of ordinary skill in the relevant arts will recognize that fewer features than illustrated in any individual embodiment described above can be utilized. The embodiments described herein are not meant to be an exhaustive presentation of the ways in which the various features may be combined. Accordingly, the embodiments are not mutually exclusive combinations of features; rather, a combination of different individual features selected from different individual embodiments can be utilized, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

References to "embodiment(s)", "embodiment(s) of the disclosure", and "disclosed embodiment(s)" contained herein refer to the specification (text, including the claims, and figures) of this patent application that are not admitted prior art.

For purposes of interpreting the claims, it is expressly intended that the provisions of 35 U.S.C. 112(f) are not to be invoked unless the specific terms "means for" or "step for" are recited in the respective claim.

What is claimed is:

1. A method of field installing a keying system to a container and a dispensing system, comprising:

providing a first key ring that includes a plurality of protrusions, said plurality of protrusions defining a protrusion pattern;

providing a second key ring that defines a plurality of pockets, said plurality of pockets defining a pocket pattern that is complementary to said protrusion pattern of said first key ring; and providing a set of instructions on a tangible medium, said instructions comprising:

coupling one of said first key ring and said second key ring to a dispense head;

coupling the other of said first key ring and said second key ring to a bung of said container, such that the other of said first key ring and said second key ring freely rotates about an exterior of a neck portion of said bung;

coupling said dispense head having said one of said first key ring and said second key ring coupled thereto with said bung having the other of said first key ring and said second key ring coupled thereto, so that said protrusion pattern is engaged within said pocket pattern; and coupling said dispense head to said bung.

2. The method of claim 1, wherein said first key ring is an inner key ring and said second key ring is an outer key ring, said inner key ring being surrounded by said outer key ring when said protrusion pattern is engaged within said pocket pattern.

3. The method of claim 2, wherein said outer key ring includes a flange portion that extends radially inward from a perimeter portion to define an inner radius.

4. The method of claim 3, wherein said bung includes external threads that define an outer radius, said outer radius being greater than said inner radius of said flange portion.

5. The method of claim 4, wherein said flange portion includes structure that defines a plurality of slots that extend radially outward from the inner radius.

6. The method of claim 1, further comprising providing a guard for insertion into said bung, said guard covering an opening of said bung to prevent particulates from entering said container, wherein said instructions provided in the step of providing instructions include:

inserting said guard into said bung before the step of coupling the other of said first key ring and said second key ring to said bung of said container; and removing said guard from said bung after said step of inserting and before the step of coupling said dispense head with said bung.

7. The method of claim 4, further comprising:

providing a guard for insertion into said bung, said guard covering an opening of said bung to prevent particulates from entering said container; and providing an assembly tool adapted to contact said outer key ring while said outer key ring is coupled to said bung of said container and while said guard is inserted within said bung, wherein said instructions provided in the step of providing instructions include:

inserting said guard into said bung before the step of coupling the other of said first key ring and said second key ring to a bung of said container;

engaging said assembly tool with said outer key ring while said outer key ring is coupled to said bung of said container and while said guard is inserted within said bung;

exerting a force on said assembly tool while said assembly tool is engaged with said outer key ring, causing said flange portion of said outer key ring to course over said external threads of said bung; and after said step of exerting, removing said assembly tool from engagement with said outer key ring and said guard from said bung.

8. The method of claim 1, further comprising:

providing a first key ring portion and a second key ring portion to joined together to form one of said first key ring and said second key ring, and wherein said instructions provided in the step of providing instructions include:

positioning said first key ring portion and said second key ring portion proximate said neck portion of said bung; and joining said first key ring portion to said second key ring portion so that said first key ring portion and said second key ring portion form one of said first key ring and said second key ring that surrounds said neck portion of said bung.

9. The method of claim 8, wherein said first key ring portion and said second key ring portion include at least one clasping structure to join said first key ring portion to said second key ring portion.

10. The method of claim 8, wherein said first key ring portion and said second key ring portion are separate components.

11. A field installation kit for keying a container and a dispensing system, comprising:

a first key ring that includes a plurality of protrusions, said plurality of protrusions defining a protrusion pattern; and a second key ring that defines a plurality of pockets, said plurality of pockets defining a pocket pattern that is complementary to said protrusion pattern of said first key ring, said protrusion pattern being configured to mesh within said pocket pattern, wherein one of said first key ring and said second key ring is adapted for coupling with a dispense head, the other of said first key ring and said second key ring is adapted for coupling with a bung of said container, the other of said first key ring and said second key ring being configured to freely rotate about an exterior of a neck portion of said bung.

12. The field installation kit of claim 11, wherein said first key ring is an inner key ring and said second key ring is an outer key ring, said inner key ring being surrounded by said outer key ring when said protrusion pattern is engaged within said pocket pattern.

13. The field installation kit of claim 12, wherein said outer key ring includes a flange portion that extends radially inward from a perimeter portion to define an inner radius.

14. The field installation kit of claim 13, wherein said bung includes external threads that define an outer radius, said outer radius being greater than said inner radius of said flange portion.

15. The field installation kit of claim 14, wherein said flange portion includes structure that defines a plurality of slots that extend radially outward from the inner radius.

16. The field installation kit of claim 11, further comprising a guard for covering an opening of said bung to prevent particulates from entering said container.

17. The field installation kit of claim 16, further comprising an assembly tool adapted surround said guard and to contact said outer key ring.

18. The field installation kit of claim 11, further comprising:

a first key ring portion and a second key ring portion that are joined together to form one of said first key ring and said second key ring.

19. The field installation kit of claim 18, wherein said first key ring portion and said second key ring portion include at least one clasping structure to join said first key ring portion to said second key ring portion.

20. The field installation kit of claim 18, wherein said first key ring portion and said second key ring portion are separate components.

21. The field installation kit of claim 18, wherein said first key ring portion and said second key ring portion are hinged together to form a clamshell arrangement.

* * * * *